United States Patent [19]

Biddulph

[11] Patent Number: 4,861,289

[45] **Date of Patent: * Aug. 29, 1989**

[54] HARDENED ELECTRICAL CONNECTOR

[75] Inventor: Stuart Biddulph, Provo, Utah

[73] Assignee: Eyring Research Institute, Inc., Provo, Utah

[ * ] Notice: The portion of the term of this patent subsequent to Jul. 5, 2005 has been disclaimed.

[21] Appl. No.: 606,672

[22] Filed: Feb. 17, 1984

[51] Int. Cl.[4] ..... H01R 4/00

[52] U.S. Cl. ..... 439/792; 439/790; 174/87

[58] Field of Search ..... 339/98, 244, 93 R, 93 C, 339/119 O, 123, 125 R, 126 R, 126 J; 174/55 B, 55 G, 5 R, 35 C, 845, 92, 87; 439/708, 790, 792, 793

[56] References Cited

U.S. PATENT DOCUMENTS

| | | | |
|---|---|---|---|
| 1,256,813 | 2/1918 | Martin | 174/87 |
| 2,359,632 | 10/1984 | Eales | 403/400 |
| 2,434,742 | 1/1948 | Hills | 174/88 C |
| 2,587,676 | 3/1952 | Akers | 174/87 |
| 4,327,369 | 4/1982 | Kaplan | 174/52 PE |
| 4,464,583 | 8/1984 | Holmgren | 174/71 C |
| 4,755,824 | 7/1988 | Biddulph et al. | 174/50 |

*Primary Examiner*—Thomas H. Tarcza
*Assistant Examiner*—Ian J. Lobo
*Attorney, Agent, or Firm*—Workman, Nydegger & Jensen

[57] ABSTRACT

A blast-hardened electrical connector for securing and maintaining electrical conductors in electrical contact. The device includes a housing having a chamber positioned near its mid portion. A plurality of conduits extend between the exterior of the housing and the chamber, each pair of conduits forming a passage within which an electrical conductor is slideably secured. Each passage passes through the chamber so that electrical conductors are brought into contact within the chamber. The chamber is configurated such that the conductors are maintained in electrical contact, even during conditions when the conductors are caused to slide axially within their respective passageways. The exterior of the connector and the conductor insulation adjacent to the exterior of the connector, are potted with an epoxy material to fix the position of insulation with respect to the connnector, and to increase structural integrity for the connector assembly.

24 Claims, 2 Drawing Sheets

HARDENED ELECTRICAL CONNECTOR

BACKGROUND

1. Field of the Invention

The present invention relates to coupling devices for connecting electrical conductors, and in particular to an apparatus and method for providing and maintaining a blast hardened electrical connection between electrical conductors.

2. The Prior Art

Coupling devices for connecting electrical conductors are well known and commonly used in numerous applications ranging from the connection of very tiny electronic circuits to physically large, high voltage electrical transmission lines. Typical coupling devices include such things as metallic sleeves which are slipped over and secured to the butted ends of the conductors, split bolt connectors, and devices having two or more clamps which are electrically connected, each clamp receiving and securing the end of a conductor.

Electrical connectors are generally designed to accomplish two goals. First, a connector is designed to secure the conductors in electrical contact during all expected operating conditions. The second goal is to protect the conducting surfaces of the conductor from exposure to undesirable conditions in the surrounding environment. In order to accomplish these goals the connectors generally secure the conductors in rigid, fixed position with respect to each other so that, even in the case of jarring or movement of the connector or the conductor, the electrical connection will be maintained. Exposure is generally prevented by providing an outer covering which may be waterproof, dust proof, or which may provide other types of protection as necessary in light of the expected operating conditions.

Although devices and methods such as those described above have been satisfactory for their intended applications under normal operating conditions, such devices and methods have generally been considered "soft" for security purposes, and have been unacceptable for applications involving operation under extreme conditions which may be created by an enemy attack or a natural disaster. "Hardness" (or "softness") is a military term to denote the system's vulnerability to destruction under attack. The harder a system is, the less vulnerable to destruction it is.

The hardness of many electrical systems requiring connector devices may be measured by such criteria as their ability to withstand substantial shock, as in the case of a powerful explosion occurring very near to the system.

When electrical connectors are utilized in systems which are exposed to conditions such as those produced by nearby explosions, the connectors become exposed to extreme forces which have such destructive power that the connectors may simply be destroyed or made unable to properly function. This is particularly true in the case of electrical connectors which are utilized for connecting conductors positioned upon or beneath the surface of the earth.

Electrical connectors are often necessary in these types of systems in order to secure and maintain electrical contact between conductors which form portions of underground or surface antennas and antenna arrays. Particular embodiments of such systems are described in the copending patent applications of Ferril A. Losee, U.S. Ser. Nos. 393,043 and 393,044, each filed on June 23, 1982, and entitled, respectively, "Wireless Communication System Using Current Formed Underground Vertical Plane Polarized Antennas" and "Low Profile Wireless Communication System and Method", both of which are incorporated herein by reference.

When an intense explosion occurs, such as that produced by a nuclear weapon, it produces shock waves which travel throughout the surrounding environment, including the air, earth, and water. As the shock waves travel through the earth, they produce a substantial displacement of the ground, which responds in a manner similar to fluid materials. Thus, the ground is actually caused to rise and fall in a wave action, with the wave amplitude being several inches or even feet depending upon the physical structure and composition of the ground and the size and location of the force which initiated the shock waves.

Conventional electrical connectors are simply not adequate for use in underground and surface communication systems which must withstand the extreme forces produced by such traveling shock waves. Under these conditions, the securely fastened and rigidly held conductors often pull free or break, since they have no way to accommodate the forces which are experienced. Thus, even though a powerful explosion may be centered some distance from the underground communication system, the resulting shock waves may likely result in breakage or separation of the conventional, tightly secured electrical connection. These types of conditions can also be associated with earthquakes and other similar natural phenomena, also with similar, unacceptable results.

It is extremely important that such communication systems and the like be constructed so as to be able to withstand the excessive forces which may occur during natural disasters or as a result of explosive shock. It is under these circumstances when the proper functioning of communication systems and other electronic equipment requiring electrical connectors is of utmost importance not only for local emergency purposes, but also to possibly preserve the national security. Nevertheless, electrical connectors capable of properly functioning under such extreme circumstances have not been provided and thus, the problem continues to exist.

As is apparent from the above discussion, what is needed in the art is a device and method for securing and maintaining electrical conductors in electrical contact, even during the extreme operating conditions which may occur during natural disasters or as a result of enemy attack. A further improvement in the art would be to provide such a blast hardened system which additionally provides for ease of installation and interconnection of the conductors to be electrically connected. Such a device and method is disclosed and claimed herein.

BRIEF SUMMARY AND OBJECTS OF THE INVENTION

The present invention comprises a novel, militarily "hard" apparatus and method for securing and maintaining electrical conductors in electrical contact. The apparatus includes top and bottom plates having a plurality of concave channels positioned on each interior face. Each channel extends inwardly from an edge of the plate and converges with the other channels in the central portion of the plate so as to define a cavity. The centrally positioned cavity may optionally have a greater concave depth than the channels in order to permit the paths of electrical conductors within the channels to cross. A first electrical conductor is positioned within channels on one plate so as to extend between the plate edges and at least partially across the cavity. A second electrical conductor is positioned within channels on the other plate so as to also extend between plate edges and at least partially across the cavity, defining a path which does not align with the path of the first conductor.

Insulation material is removed from at least a portion of that length of each conductor which is adjacent to the face of a plate. The plates are secured together in face-to-face configuration so that the aligned channels define conduits through which the conductors extend, and the aligned cavities define a chamber within the connector. As a result of the configuration of the chamber walls in conjunction with the conduits, the conductors are caused to converge within the chamber, where they are maintained in contact with each other.

Any bare portion of the conductor extending outside the connector body is coated with a silicone rubber compound to protect the conductor while also allowing its slideable movement in response to high tension forces on the conductor. The exterior surfaces of the connector and the insulated or silicone rubber coated portions of the conductors positioned near the connector exterior are potted with epoxy material in order to provide further blast hardness for the connector, and to fix the position of the conductor insulation and silicone rubber with respect to the connector.

The adjacent plates are configured such that some slideable play of the conductors is permitted within the conduits and the chamber in response to preselected levels of tension forces experienced by the conductors. Thus, when the connectors or conductors are subjected to sudden violent movement, the conductor accommodates limited displacement relative to the connector. Even during displacement, electrical connection between the conductors is continuously maintained within the chamber.

It is therefore a primary object of the present invention to provide an improved electrical connector which is blast hardened.

Another important object of the present invention is to provide such a hardened connector which provides for continued electrical connection of the conductors, under conditions of violent movement of force applied to the connector and/or the connected conductors.

Still a further object of the present invention is to provide a blast hardened connector which is simple in construction and provides for easy and rapid assembly.

These and other objects and features of the present invention will become more fully apparent from the following description and appended claims taken in conjunction with the accompanying drawings.

DETAILED DESCRIPTION OF THE PREFERRED EMBODIMENT

Reference is now made to the drawings wherein like parts are designated with like numerals throughout.

For purposes of explanation, the device illustrated in FIGS. 1–4 comprises one particular preferred embodiment of the hardened electrical connector as it is utilized in an earth surface or buried antenna system for connecting antenna array elements.

Figure 1:
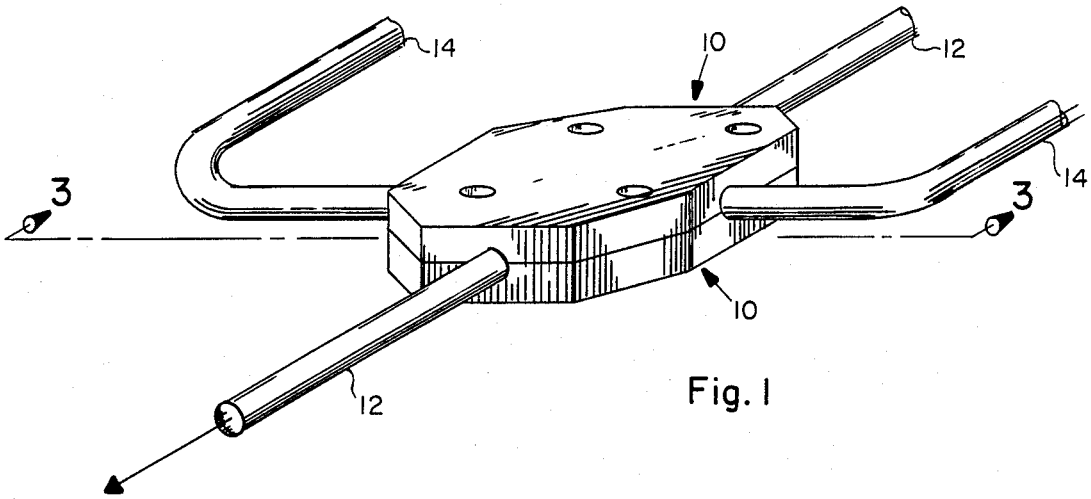
FIG. 1 is a perspective illustration of one presently preferred embodiment of the hardened connector, as used for connecting antenna elements in a communication system.

The system can best be described by reference to FIG. 1, wherein the connector is generally illustrated at 10. The connector 10 is illustrated in an octagonal configuration which reduces surface exposure to blast shock waves and the like. However, the connector 10 can properly function in any of numerous configurations. Connector 10 is typically constructed of metallic material such as stainless steel in order to provide for electrical connection through its own body as well as by direct contact between electrical conductors. Nevertheless, a non-conductive housing constructed of materials such as high-impact plastics could also be utilized and still maintain electrical contact between conductors.

Connector 10 is interconnected via conductor 12 through an impedance matching device (not shown) to a transmitter/receiver (not shown). The impedance matching device provides for a proper impedance match between a system feed line and the antenna elements. One particular type of blast-hardened impedance matching device which is of value in surface and underground deployed antenna systems is described in our copending patent application U.S. Ser. No. 566,422, filed Dec. 23, 1983 and entitled "Impedance Matching Device," which is incorporated herein by reference.

Connector 10 defines a connection for two conductors 12 and 14. The conductors 12 and 14 may comprise tree members which are part of an antenna array as described in copending application Ser. No. 566,422, filed Dec. 23, 1983 which is herein incorporated by reference.

Figure 2:
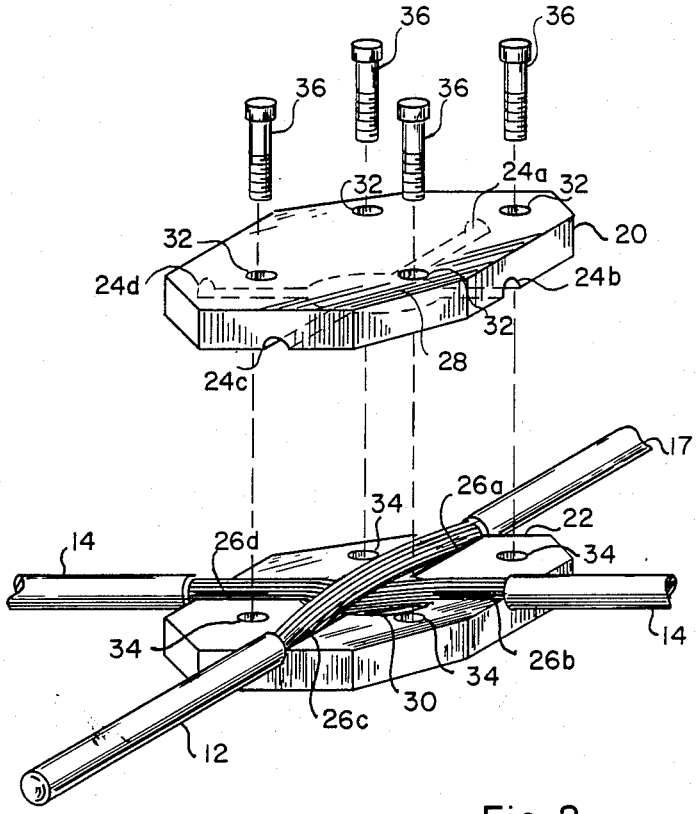
FIG. 2 is an exploded perspective view of the hardened connector of the present invention, showing the configuration of the interconnected transmission lines as they are positioned therein.

The connector development of the present invention may be described in more detail by reference to FIG. 2. Specifically, connector 10 includes a top plate 20 and a bottom plate 22 which are preferably constructed so as to comprise substantially reverse images of one another. The inwardly directed faces of each of adjacent plates 20 and 22 include a plurality of channels **24*a*, 24*b*, 24*c*, 24*d*, 26*a*, 26*b*, 26*c* and 26*d*, whose outer ends terminate at the outer edge of the plate member. The interior end of each channel connects to a concave, bowl shaped cavity 28 and 30** which is positioned in substantially the central portion of the plate.

Each of plates 20 and 22 also include a plurality of bolt holes 32 and 34 which extend in common positions through the body of each plate. Bolt holes 34 in the lower plate 22 are threaded so as to define female receivers, while bolt holes 32 in top plate 20 have smooth walls. Plates 20 and 22 are assembled to form connector 10 by positioning the respective, mirror imaged, internal surfaces of the plates adjacent one another and aligning bolt holes 32 and 34. Plates 20 and 22 are maintained securely adjacent one another, forming the connector 10, by socket head cap screws 36 which extend downward through each bolt hole 32 and into the adjacent bolt hole 34, wherein they are threadably received.

In normal use, insulation is stripped from a portion of conductor 12 to form a bare conductor of a length which is substantially equal to or slightly greater than the distance between the edges of the plate. The bare position of the conductor 12 is positioned so as to lie within channels **26*a* and 26*c*, with a portion of the bare conductor extending across the cavity 30. The insulation from a portion of a second conductor 14 is also stripped in the manner described above, and the bare portion of conductor 14, is positioned within channels 26*b* and 26*d* so that a portion of the bare conductor extends across the cavity 30, and so that the bare conductors 12 and 14 are caused to physically contact when plates 20 and 22 are secured together. With the conductors in place, the top plate 20 is secured to bottom plate 22** in the manner previously described.

Figure 3:
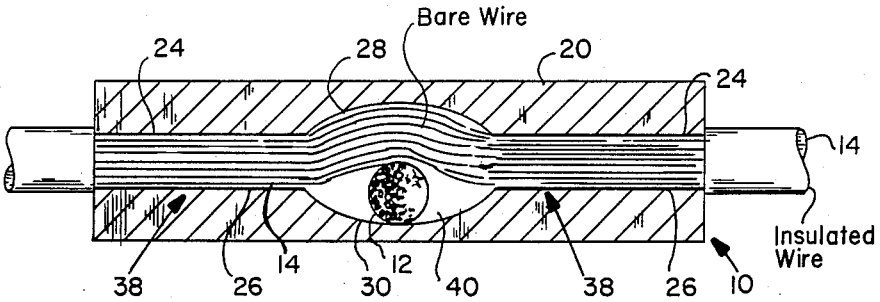
FIG. 3 is a side cross-sectional illustration of the embodiment of FIG. 1 taken along line 3—3, showing the relative positions of the conductors within the chamber of the electrical connector.

Referring now to FIG. 3, it can be seen that, with the plates secured adjacent one another, channels **24*a*–24*d* and 26*a*–26*d* cooperate to form conduits or ports (generally indicated at 38) within which the conductors 12 and 14 are positioned. In like manner, the cavities 28 and 30 cooperate to form a chamber in the central portion of the connector 10, within which the conductors 12 and 14** are caused to contact.

From FIG. 3 it is apparent that the conduits 38 and the chamber 40 are sized so that the conductors which extend therethrough are held securely in electrical contact under normal operating conditions, but are provided with the ability to slide in an axial direction in response to forces applied to the connector or the conductors. It will also be noted that, although the conductors are permitted to slide axially, the walls of the chamber 40 are configurated so that electrical contact is maintained between the conductors, even when sliding.

The pressure of the conduit walls and the chamber walls on conductors 12 and 14 is a significant factor in determining the extent to which the conductors are slideable within the connector. For example, in the case where conductors 12 and 14 comprise 100 ohm transmission lines in a buried antenna array, conduit and chamber wall pressure is designed to permit some slideable movement in response to tension forces in excess of about 1000 pounds per square inch on the conductors. Of course, this threshold tension value may be set to a different level depending upon the conductor size and the type of application of the electrical connector. Thus conduit size and chamber size, as well as tension maintained between adjacent plates 20 and 22, should be designed based upon the expected conductor size and application of the connector 10.

It will be appreciated that the bare conductors 12 and 14 are not only slideable within the conduits 38 and chamber 40, but they are also typically somewhat slideable within the insulation which surrounds them outside the connector body. Thus, in the illustrated embodiment, it is intended that the insulation be held fixed while the conductor itself be permitted to slide in response to application of extreme forces. In order to facilitate the fixing of the insulation with respect to the connector while permitting conductor slideability therein, it is first desirable to place a covering or coating such as insulation on all portions of bare conductor which may extend outside and adjacent to the connector body. One type of coating which provides the desired result is a conventional silicone rubber compound such as the product sold by General Electric Company under the trademark "RTV." This compound function much like insulation in that the encased conductor may be slideable therein but is protected from direct exposure to the elements.

Figure 4:
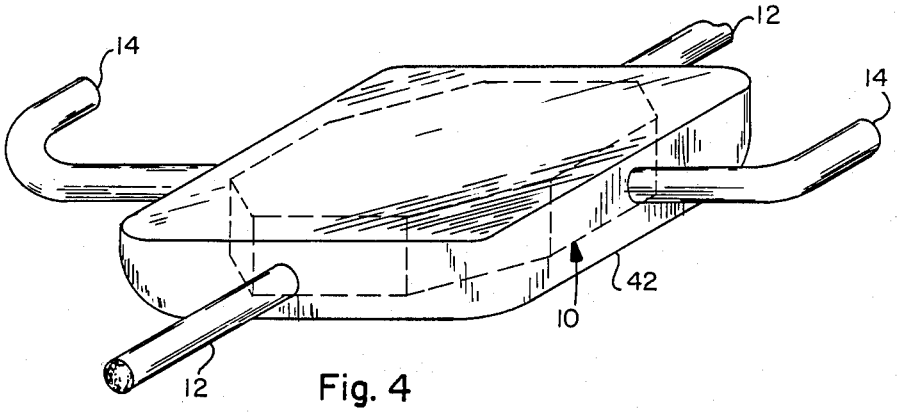
FIG. 4 is a perspective illustration of the embodiment of FIG. 1, illustrating the connector after it is potted in resinous material.

By reference to FIG. 4 it may be seen that the insulation, including the silicone rubber compound, surrounding conductors 12 and 14 adjacent the exterior surfaces of connector 10 is secured in place, with respect to the edges of the connector 10, by encasing ("potting") the connector, the silicone rubber compound and the adjacent ends of the insulation in a protective resinous material such as epoxy 42. Potting the connector with epoxy not only secures the insulation and the silicone rubber compound, but the epoxy forms a very strong, resilient casing about the entire connector assembly. Thus, the potted connector assembly is rendered militarily hard, in that it can withstand even the extreme forces produced by an explosion-induced shock wave.

Figure 5:
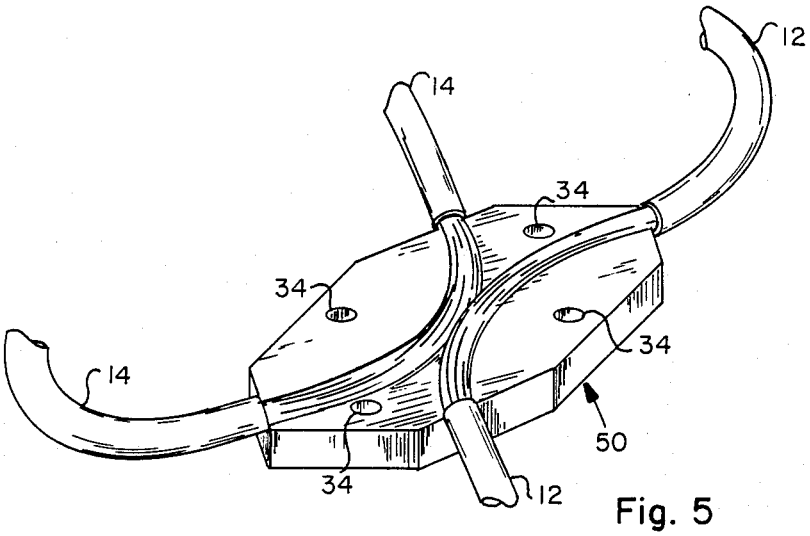
FIG. 5 is a perspective illustration of the lower plate and conductors of another preferred embodiment of the hardened connector of the present invention.

FIG. 5 illustrates a lower plate 50 and conductors 12 and 14 comprising a portion of another preferred embodiment of the present invention. In this embodiment the channels are oriented such that conductors 12 and 14 positioned therein do not cross within the chamber 40. Rather, the channels define generally curved paths so that the conductors 12 and 14 are maintained in side-by-side electrical contact within the chamber 40. In fact, since the conductors 12 and 14 do not cross one another, chamber 40 merely defines the widened portion of the conduit wherein the conductors converge. No other cavity in the face of plates 20 or 22 is required or provided in this embodiment.

The side-by-side relationship is produced as a result of the configuration of the walls of chamber 40, and of the path of the conductors defined by the channels. As is the case with the embodiment of FIGS. 2 and 3, the upper plate (not shown) of the embodiment of FIG. 5 is the reverse image of the lower plate 50 and is secured in place adjacent the lower plate 50 by socket head cap screws (not shown) to form an electrical connector. This embodiment is also potted with an epoxy type material after assembly, in the manner described above.

Although the embodiments described and illustrated herein depict the connector 10 as providing connection for only two conductors, one skilled in the art will recognize that additional channels could be utilized for introducing more conductors to be connected. So long as all conductors are secured in electrical contact within the chamber, a large number of conductors may be provided for. The sizes of the conduits and of the chamber are determined by the size and number of conductors to be connected within the device. Moreover, as a matter of choice, the plates 20, 22 or 50 may be configured such that one plate is essentially flat and the other grooved to receive substantially all of the conductor.

From the foregoing description it will be appreciated that the novel, hardened connector development disclosed herein clearly overcomes many of the longstanding problems in the art by (1) providing a blast-hardened connector which functions to secure and maintain electrical conductors in electrical contact, even in response to extreme displacement forces; (2) providing such a blast-hardened connector which may be utilized effectively in underground, surface and above-ground applications; and (3) providing such a hardened connector assembly which is quickly and easily assembled for operation.

The invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An apparatus for securing and maintaining electrical conductors at or near the earth's surface in electrical contact under conditions of displacement of the earth comprising:

means for carrying a non-insulated portion of a first electrical conductor within a housing;

means for carrying a non-insulated portion of a second electrical conductor within the housing so as to be in electrical contact with the first conductor; and means for permitting said first and second conductors to slide relative to one another at the point of electrical contact between them while still continuously maintaining electrical contact.

2. An apparatus for securing electrical conductors as defined in claim 1 wherein the first and second conductors are not insulated along their lengths.

3. An apparatus for securing electrical conductors as defined in claim 1 wherein the first and second conductors cross within the housing.

4. An apparatus for securing electrical conductors as defined in claim 1 wherein the means for carrying the first and second conductors within the housing comprise a plurality of conduits extending through the housing interior.

5. An apparatus for securing and maintaining electrical conductors in electrical contact at or beneath earth surface during shock-induced earth displacement comprising:

a housing comprising first and second conduits which converge therein;

means for slideably securing a non-insulated portion of a first conductor within said first conduit defined through the housing;

means for slideably securing a non-insulated portion of a second conductor within said second conduit defined through the housing, thereby bringing the first and second conductors into electrical contact at the point where said conduits converge; and means for permitting said conductors to slideably move within said conduits while still maintaining electrical contact between the first and second conductors when the first and second conductors are axially displaced through said conduits.

6. An apparatus for securing electrical conductors as defined in claim 5 wherein each conductor is bare along its length.

7. An apparatus for securing electrical conductors as defined in claim 6 wherein those portions of conductor positioned substantially adjacent but external to the housing are coated with an insulation material.

8. An apparatus for securing electrical conductors as defined in claim 7, further comprising means for fixing the position of insulation on the conductors with respect to the housing.

9. An apparatus for securing electrical conductors as defined in claim 8 wherein the means for fixing the position of insulation comprises means for covering exterior surfaces of the housing and the insulation such that the housing and covered insulation are protected from external physical forces.

10. An apparatus for securing electrical conductors as defined in claim 5, further comprising means for protecting the housing and adjacent conductors from external, physical forces with a synthetic resinous matrix.

11. An apparatus for securing and maintaining electrical conductors at or beneath the earth's surface in electrical contact comprising:

a housing defining a cavity therein;

a first port in the housing through which a first conductor may slideably extend into the cavity, the portion of the first conductor within the cavity being uninsulated;

a second port in the housing through which the first conductor may slideably extend outwardly from the cavity;

a third port in the housing through which a second conductor may slideably extend into the cavity, the portion of the second conductor within the cavity being uninsulated;

a fourth port in the housing through which the second conductor may slideably extend outwardly from the cavity;

the first and second ports being aligned with respect to the third and fourth ports such that the first and second conductors extend within the cavity in converging relationship; and the first and second conductors being permitted to axially slide through said ports while still being maintained in electrical contact within the cavity.

12. An apparatus for securing electrical conductors as defined in claim 11 wherein at least that portion of each conductor which is in electrical contact is bare.

13. An apparatus for securing electrical conductors as defined in claim 12 wherein those portions of conductor positioned substantially adjacent but external to the housing are coated with an insulation material.

14. An apparatus for securing electrical conductors as defined in claim 13, further comprising means for fixing the position of insulation on the conductors with respect to the housing.

15. An apparatus for securing electrical conductors as defined in claim 11, further comprising means for protecting the housing and adjacent conductors from exposure to surrounding environmental conditions.

16. An apparatus for securing electrical conductors as defined in claim 15 wherein the means for protecting the housing comprises an epoxy material which is coated around the exterior of the housing and adjacent conductors.

17. An apparatus for securing electrical conductors as defined in claim 11 wherein the ports and cavity are configured such that conductors positioned therein are caused to cross within the cavity.

18. An apparatus for securing electrical conductors as defined in claim 11 wherein the ports and cavity are configured such that the conductors are maintained in side-by-side contact within the cavity.

19. An apparatus for securing and maintaining electrical conductors in electrical contact comprising:

a first plate having a cavity on an interior face;

a second plate whose interior face is positionable adjacent the interior face of the first plate, and wherein the second plate has a cavity on its interior face which is aligned with the cavity on the first plate so as to form a chamber defined by said cavities;

a plurality of channels in the interior faces of the first and second plates, each channel extending between the cavity and an outer edge of the plate, wherein the channels of each plate are aligned so as to form converging conduits within which said conductors are slideably secured, said conductors each comprising a portion which extends into said chamber when the plates are secured together;

wherein said conductors are free to slideably move relative to one another at the point of electrical contact between them; and wherein the chamber is configured so as to maintain said conductors in electrical contact with one another even when said conductors slide relative to one another.

20. An apparatus for securing electrical conductors as defined in claim 19, further comprising means for securing the first plate in mating configuration with the second plate and for adjusting pressure between the secured plates, thereby controlling the pressure applied to conductors within the channels and cavities so as to select a tension level beyond which the conductors may slide within the channels and cavity.

21. An apparatus for securing electrical conductors as defined in claim 19 wherein those portions of conductor positioned substantially adjacent but external to the housing are coated with an insulation material.

22. An apparatus for securing electrical conductors as defined in claim 21, further comprising means for fixing the position of insulation on the conductors with respect to the housing.

23. An apparatus for securing electrical conductors as defined in claim 19 further comprising means for protecting the housing and adjacent conductors from exposure to surrounding environmental conditions.

24. An apparatus for securing electrical conductors as defined in claim 23 wherein the housing is electrically conductive and the means for protecting the housing comprises an insulative epoxy material which is coated around the exterior of the conductive housing.

* * * * *